US009840807B2

(12) United States Patent
Luzon

(10) Patent No.: US 9,840,807 B2
(45) Date of Patent: Dec. 12, 2017

(54) PROCESS FOR DYEING TEXTILES, DYEING AND FORTIFYING RUBBER, AND COLORING AND REVITALIZING PLASTICS

(71) Applicant: Charles Francis Luzon, North Attleborough, MA (US)

(72) Inventor: Charles Francis Luzon, North Attleborough, MA (US)

( * ) Notice: Subject to any disclaimer, the term of this patent is extended or adjusted under 35 U.S.C. 154(b) by 0 days.

(21) Appl. No.: 14/544,960

(22) Filed: Mar. 10, 2015

(65) Prior Publication Data

US 2016/0265158 A1 Sep. 15, 2016

(51) Int. Cl.

| | |
|---|---|
| ***D06P 1/44*** | (2006.01) |
| ***D06P 1/90*** | (2006.01) |
| ***D06P 1/00*** | (2006.01) |
| ***D06P 1/52*** | (2006.01) |
| ***D06P 1/653*** | (2006.01) |

(52) U.S. Cl.

CPC ..... *D06P 1/0008* (2013.01); *D06P 1/44* (2013.01); *D06P 1/5271* (2013.01); *D06P 1/6533* (2013.01); *D06P 1/6536* (2013.01); *D06P 1/90* (2013.01)

(58) Field of Classification Search

CPC ..... D06P 1/0008; D06P 1/44; D06P 1/5271; D06P 1/6533; D06P 1/6536; D06P 1/90

See application file for complete search history.

(56) References Cited

U.S. PATENT DOCUMENTS

| | | | | |
|---|---|---|---|---|
| 3,166,429 | A * | 1/1965 | Wich | C09B 67/006 106/169.1 |
| 3,953,168 | A | 4/1976 | Fabbri et al. | |
| 4,065,254 | A | 12/1977 | Buhler et al. | |
| 4,210,565 | A | 7/1980 | Emmons | |
| 4,226,637 | A * | 10/1980 | Linden | C09B 67/0008 106/262 |
| 4,270,236 | A | 6/1981 | Zurbuchen et al. | |
| 4,329,146 | A | 5/1982 | Zurbuchen et al. | |
| 4,397,650 | A | 8/1983 | Gregorian et al. | |
| 4,487,855 | A | 12/1984 | Shih et al. | |
| 4,622,040 | A | 11/1986 | Nichols | |
| 4,622,041 | A | 11/1986 | Nichols | |
| 4,622,042 | A | 11/1986 | Nichols | |
| 4,740,214 | A | 4/1988 | McBride et al. | |
| 4,816,035 | A | 3/1989 | Craycroft et al. | |
| 5,029,870 | A | 7/1991 | Concepcion et al. | |
| 5,296,284 | A | 3/1994 | Durham | |
| 5,330,540 | A | 7/1994 | McBride et al. | |
| 5,512,062 | A | 4/1996 | Fuller et al. | |
| 5,618,619 | A | 4/1997 | Petrmichl et al. | |
| 5,833,720 | A | 11/1998 | Kent et al. | |
| 5,984,979 | A | 11/1999 | Bella et al. | |
| 6,036,998 | A | 3/2000 | Calvo et al. | |
| 6,177,496 | B1 * | 1/2001 | Luzon | C08J 7/047 427/207.1 |
| 6,296,672 | B1 | 10/2001 | Barfoed et al. | |
| 6,389,627 | B1 | 5/2002 | Annen | |
| 6,534,588 | B1 | 3/2003 | Locken et al. | |
| 6,544,297 | B1 | 4/2003 | Liu et al. | |
| 6,653,394 | B1 | 11/2003 | Meisenburg et al. | |
| 6,676,710 | B2 | 1/2004 | Smith et al. | |
| 6,716,905 | B1 | 4/2004 | Bremser et al. | |
| 7,201,780 | B2 | 4/2007 | Schoots | |
| 7,361,702 | B2 | 4/2008 | Schwalm et al. | |
| 7,398,660 | B2 | 7/2008 | Shalev et al. | |
| 7,674,300 | B2 | 3/2010 | Janssen et al. | |
| 7,740,666 | B2 | 6/2010 | Janssen et al. | |
| 7,960,031 | B2 | 6/2011 | Pickett et al. | |
| 8,182,552 | B2 | 5/2012 | Janssen et al. | |
| 8,182,712 | B1 | 5/2012 | Maekawa et al. | |
| 8,439,982 | B2 | 5/2013 | Yager | |
| 8,523,957 | B2 | 9/2013 | Arioglu et al. | |
| 8,877,295 | B2 | 11/2014 | Chilla | |
| 2002/0119314 | A1 | 8/2002 | Coffey | |
| 2002/0128366 | A1 | 9/2002 | Coffey | |
| 2004/0194234 | A1 | 10/2004 | Bartl et al. | |
| 2005/0274284 | A1 * | 12/2005 | Rosenhahn | C01G 49/06 106/456 |
| 2006/0124017 | A1 | 6/2006 | Adam et al. | |
| 2006/0258784 | A1 | 11/2006 | Adam et al. | |
| 2006/0282957 | A1 | 12/2006 | Schoots | |
| 2009/0158534 | A1 | 6/2009 | Jungen et al. | |
| 2009/0255064 | A1 | 10/2009 | Jungen et al. | |
| 2010/0047531 | A1 | 2/2010 | Baum et al. | |
| 2011/0073171 | A1 | 3/2011 | Pickett et al. | |
| 2011/0083283 | A1 | 4/2011 | Valldeperas-Morell | |
| 2012/0047665 | A1 | 3/2012 | Yager | |
| 2012/0309077 | A1 | 12/2012 | Sachdev | |
| 2013/0243962 | A1 | 9/2013 | Lomoelder et al. | |
| 2014/0057115 | A1 | 2/2014 | Treadway | |
| 2014/0338809 | A1 | 11/2014 | Nakamura | |
| 2014/0342100 | A1 | 11/2014 | Valeri | |
| 2014/0360645 | A1 | 12/2014 | Sakamoto et al. | |
| 2015/0004424 | A1 | 1/2015 | Kruesemann et al. | |

* cited by examiner

FOREIGN PATENT DOCUMENTS

DE 10 2012204298.9 3/2012

*Primary Examiner* — Amina Khan

(57) ABSTRACT

A method for: (1) The application of solvent-based resin formulations to various forms and classes of textile fibers, fabrics, and finished goods which, when dyes or pigments are included, will impart color to textile materials; (2) The application of the formulations to various forms of rubbers, natural and synthetic, in the pre-formed state or subsequent to forming a finished product which will impart color and fortification; (3) The application of the same group of formulations to revitalize plastic surfaces and impart color to plastics prior to and subsequent to forming finished products; (4) The application of the same formulations to polymers for the purpose of carrying additives for purposes such as, but not limited to, sizing, mildew resistance, UV protection, glazing, creation of printable or paintable surfaces, artistic coloring effects, abrasion resistance, stain resistance, mercerizing, and many more, with or without dyes or pigments included.

5 Claims, No Drawings

PROCESS FOR DYEING TEXTILES, DYEING AND FORTIFYING RUBBER, AND COLORING AND REVITALIZING PLASTICS

FEDERALLY SPONSORED RESEARCH

Nonapplicable.

SEQUENCE LISTING OR PROGRAM

Nonapplicable.

BACKGROUND

1. Field of the Invention

This invention relates to innovative processes used to dye textile materials, to dye and fortify rubber materials prior to and after product formation, and to color and revitalize plastic prior to and after product formation. Because it employs a particular chemical bonding system, it should be considered useful on a wide selection of natural and synthetic organic polymers and organic chain polymers to achieve a broad range of desired effects, among them, but not limited to, mildew resistance, sizing, creation of printable or paintable surfaces, glazing, sheen, artistic coloring effects, UV protection, abrasion resistance, and many more.

2. Prior Art

Textile dyeing has been done for thousands of years; the process has almost always involved the application of a pigment or dye in solution which, when heated and applied to a textile, would allow the colorant (dye or pigment) to seat itself in the fibres of the textile material. An after-process of curing using heat is employed to fix the colorants and to regularize the color dispersion and to dry the dyed end-product, thereby allowing the colorant to be as fixed to the textile as possible. This general approach has been used since dyes and pigments were derived from natural sources such as shellfish through the era where coal-tar derivatives were used and through the era where synthetic dyes and pigments were developed, which is the current state of the art. Chemically different coloring solutions and varying degrees of heat are required for the different classes of fibres: cellulosic, polyester, amide, aramide, for example. Different equipment is also required to apply those processes: highly-pressurized kettles, heated dye troughs, pre-wash baths, finishing ranges which can be anywhere from one roller of 36" diameter to ranges fully two stories high and several hundred feet in length, etc. Some textile materials, such as polypropylene, Kevlar, Nomex, Teflon, etc remain resistant to the above processes and were, until now, considered undyeable. In most textile manufacturing facilities, the bottleneck which limits the amount of available finished goods occurs in the processing department (which includes the dyeing processes). One way of alleviating that bottleneck is to send raw textile goods (yarn, fabric, etc) to a dyehouse, that is, another company who will contract dye yarn or fabric if the end-user does not have dye kettles, continuous dye ranges. or other proper equipment and expertise of their own. This contract-dyeing is employed by a great percentage of textile manufacturers. This invention will address some of the problems inherent in the aforementioned state-of-the-art processes, provide dyes for fibres previously considered undyeable, save costs when compared with current methods, and greatly streamline the process of dyeing while yielding a finished dyed product as good or better than that produced by means currently employed.

Note that the terms used relative to textile applications in the descriptions herein are known and understood by persons conversant with current textile treatment procedures.

Among existing active patents and applications, none could be found which describe a complete dyeing system with a process which is novel in both concept and execution as compared with current practices used in the textile industry. The nearest relevant related art falls into several categories: (A) Dyeing for Special Fabric Effects: U.S. Pat. No. 8,523,957 Arioglu, et al is concerned with cellulosic fibres (cotton denim and blends); U.S. Pat. No. 7,201,780 Schoots Apr. 10, 2007 is limited to cotton or cotton blends dyeing; Application 20060282957 Schoots Dec. 21, 2006 is an improvement on his previous patent, similar processes described; U.S. Pat. Nos. 4,740,214 and 5,330,540 McBride et al both deal with specific dye effects (mottled or hammered appearance and pattern dyeing) in which heat is used; U.S. Pat. Nos. 4,622,040 and 4,622,041 and 4,622,042 Nichols Nov. 11, 1986 describe three methods of dyeing tufted nylons for carpets; U.S. Pat. No. 4,397,650 Gregorian, et al deals with dyestuffs added to a foamed composition for specialized effects (carpets). (B) Stimulation of Dye Bath to Encourage Penetration: U.S. Pat. Nos. 4,270,236 and 4,329,146 Zurbuchen et al; U.S. Pat. Nos. 7,740,666 and 7,674,300 and 8,182,552 Janssen, et al; U.S. Pat. No. 8,182,712 Maekawa, et al; U.S. Pat. No. 8,439,982 and Application 20120047665 Yager all refer to exotic stimulants to improve dye penetration such as electrophoresis, superheated steam, electric current, magnetoheological fluid, ultrasonic vibration, microwaves and are not dye systems per se, but system enhancers. (C) Additives for Dye Penetration and Fixatives: U.S. Pat. No. 4,065,254 Buhler, et al; U.S. Pat. No. 5,833,720 Kent et al; U.S. Pat. No. 5,984,979 Bella, et al; U.S. Pat. No. 6,296,672 Barfoed, et al; U.S. Pat. No. 6,544,297 Liu et al; U.S. Pat. No. 4,065,254 Buhler et al; U.S. Pat. No. 3,953,168 Fabbri, et al; U.S. Pat. No. 6,389,627 Annen; U.S. Pat. No. 6,676,710 Smith, et al; and Applications 20120309077 Sachdev; 20100047531 Baum, et al; 20090158534 and 20090255064 Jungen et al describe additives to heated dyebaths to enhance dye penetration and attachment such as oleylamines, bioscouring enzymes, enzyme catalysts, alkali solutions, supercritical fluid carbon dioxide, diazonium salts, etc, and are adjuncts to presently standard dye systems. (D) Dye Methods for Specific Situations: U.S. Pat. No. 7,398,660 Shalev, et al requires heat and specially-designed apparatus for application; U.S. Pat. No. 5,512,062 Fuller et al uses heat (under 100 degrees C.) for carpet dyeing; U.S. Pat. No. 4,816,035 Craycroft, et al involves heating (below 280 degrees F.), rinsing and at least two stages of heating; Application 20110083283 Valldepras-Morell, et al refers to recycled dye baths and uses heat to dye a limited range of fibres; Application 20040194234 Bartl, et al describes a process for use on non-wovens which requires heat (150-240 degrees C.) and treatment times of 15 seconds to 60 minutes.

In the area of rubber coloring, the literature is sparse. U.S. Pat. No. 6,036,998 Calvo et al refers to a paint application to the outer surface of rubber, not a true dye of the rubber itself, and requires heat; U.S. Pat. No. 5,296,284 Durham describes a pigment used to make inks and paints for rubber application; Applications 20140338809 Nakamura and 20140360645 Takashi, et al describe adding color to tires by affixing a separate rubber piece of a different color to black tires (The present inventor has spoken with the assignee of these applications and they do not have a product or process which will accomplish what the process of this application will); Applications 20020119314 and 20020128366 Coffey are pigment coatings using heat for application, not dyes, for use on recycled tires used in playgrounds, road surfaces, soil additives, and landscaping mulch. These processes are different from the process described in this application in that they require heat to apply, are not intrinsic dyes, and are used on rubber materials which do not require close performance tolerances with respect to stretch, modulus, recovery, etc, which means these processes could not be used on, for example, rubbers used as textile elastomers. The present invention will not greatly change the performance characteristics of rubbers that have functions more sophisticated than the end-uses specified in the prior art.

As concerns applications for coating and/or coloring plastics, U.S. Pat. No. 7,361,702 Schwalm, et al, U.S. Pat. No. 6,716,905 Bremser, et al, U.S. Pat. No. 6,653,394 Meisenburg, et al and U.S. Pat. No. 6,534,588 Locken, et al are primarily for OEM automotive paint use as UV inhibitors, free radical inhibitors, etc. The present inventor has dealings with the assignee of the foregoing patents and has been assured there is no BASF product which functions like the present invention. U.S. Pat. No. 5,029,870 Concepcion, et al describes a golf ball coating which is a paint/primer and sealant 2-step process, and is not a dye. Application 20150004424 Kruesemann, et al, is also a base coat/sealant 2-step application for OEM automobile paint which requires heat to address "jetness" of blacks and UV protection by using pigments (also a BASF Application). U.S. Pat. No. 4,487,855 Shih, et al is primarily concerned with styrene plastics, is aqueous-based, and is used in the liquid latex form and requires heat (at room temperature this process would take from 1-35 days to complete). Applications 20060124017 and 20060258784 Adam, et al requires sophisticated plastics manufacturing apparatus with a good deal of heat and are for use in a pre-extrusion (i.e., pellet form) state. Applications 20140342100 Valeri, 20140057115 Treadway, and U.S. Pat. No. 5,618,619 Petrmichl, et al are for use primarily as abrasion-resistant coatings in optical products and require heat in application. Similarly, U.S. Pat. No. 7,960,031 and Application 20110073171 Pickett, et al, require heat to provide UV protection, abrasion resistance, etc. U.S. Pat. No. 8,877,295 Chilla is for a primer and color coat (2 steps) for auto plastics and requires heat. U.S. Pat. No. 4,210,565 Emmons has a multi-purpose coating, uses heat in a multi-step application process. Application 20130243962 Lomoelder, et al describes a coating, solvent-based, for use on OEM automobile finishes and uses heat for curing (up to 80 degrees C.); see also German Patent Application DE 10 2012204298.9 Mar. 19, 2012. This application presents options reminiscent of U.S. Pat. No. 6,177,496 Luzon, especially in the use of diisocyanate variations. This last mentioned Patent is distinct from the present invention because it refers to coatings used for various purposes, not intrinsic dyes, but coatings which may carry colors; it also differs in that there are no surface preparations necessary for the vast majority of uses of the present invention. As the present invention does not require heat, it is distinct from nearly every reference in the sources; furthermore, there was no mention of use of these coatings as "plastics revitalizers," that is, a coating which will bring a plastic surface back to as good, or in many cases, better than original appearance while at the same time providing a cleaner for that surface, a protective layer, and, if desired, a color. These advantages are gained by a one-wipe application at room temperature, air dried, with no need for heat curing.

SUMMARY

This invention relates to the use of formulations and their variations and derivatives for the purposes of (a) dyeing the broad range of textile classes of fibres, for example, but not limited to, cellulosic, polyesters, polypropylenes, cottons, rayons, amides, aramides, etc without the use of heat; (b) dyeing and fortifying rubber, natural and synthetic, whether in the pre-formed state or the finished product state without substantially changing the elastomeric functions of rubber, such as, but not limited to, stretch, recovery, modulus, etc when used in products where the stretching is critical and in those products in which the ability of rubber to stretch and recover is not as critical; © applying the same group of related formulations to revitalize and/or color plastics before and after product formation; (d) applying the same formulations to polymers for the purpose of carrying a broad range of additives such as, but not limited to, UV protection, polyvinyl acetates (PVA) and other sizing agents, glazing, abrasion resistance, mercerizing, mildew resistance, stain resistance, weather protection, flame resistance, agents to promote printability and printability, agents to promote artistic coloring effects, and many more, with or without dyes or pigments.

DRAWINGS

Nonapplicable.

DETAILED DESCRIPTION

This invention involves the application a specific group of formulations to organic polymers such as, but not limited to, textiles, natural and synthetic rubbers, plastics, etc. There are a broad number of uses given, but, in the inventor's opinion, they should be grouped under one application because the basic formulation will accomplish any of the uses listed in the Field of the Invention; the adjustments made to the formulations to address specific circumstances in different industries are relatively minor and would be employed to make this invention more useful to specific circumstances in particular application situations. The reason these formulations are so adaptable is that they chemically bond with natural and synthetic polymers in a way not seen before by the manufacturers of the aforementioned materials and products, yet do not alter the original character of the material treated. That one could be able to apply a solvent-based formulation to, for example, natural and synthetic rubber, without changing the performance characteristics of those materials, and, in fact, increasing the usable lifespan of that material, and dyeing it at the same time, was not accomplished for functions listed in this application until this invention. Similarly, textiles and plastics retain their original characteristics, visually and functionally, excepting, of course, for the color when the formulations are used as a dye carrier.

One base formulation which will accomplish the foregoing, though it should not be considered unique because of the large number of possible additions, quantity adjustments, component substitutions, etc as preferred for optimizing effects in different tasks, is given:

| | |
|---|---|
| Solvent aliphatic hydrocarbons | 40-85% |
| Alkyd resin compound including: | 07-35% |
| Petroleum distillates (>=10-<30%) | |

-continued

| | |
|---|---|
| Ethanol, 2-propoxy-(>=01-<5%) | |
| Nonane (<1%) | |
| Light Aromatic Solvent Naphtha compound including: | 05-15% |
| Trimethylbenzene 1,2,4-(>=30-<40%) | |
| Trimethylbenzene 1,3,5-(>=5-<10%) | |
| Xylene (>=1.5-<5%) | |
| Cumene (>=1.5-<5%) | |
| Diethylbenzene (>=1.5-<5%) | |
| N-Methyl-2-pyrrolidone (NMP)) | 01-05% |
| 2 Butanone Oxime | 0.5-1.5% |
| Cobalt Octoate 6 or 12% | .01-1% |
| Calcium Naphthenate | .05-.3% |
| Zirconium Octoate | .2-.8% |

Note: While the Alkyd resin compound should be made to specifications which suit the intended use, a user should also be aware that Arkema, Inc supplies a product, Chempol 818-0237 (and some variations), which may be acceptable for some uses, and saves the user additional compounding costs. Similarly, Nexeo Solutions, Inc of Columbus, Ohio supplies a product Hi-Sol 10 (and some variations) which may serve for the Light Aromatic Solvent Naphtha compound in certain cases.

First Embodiment

The process which accomplishes the aforementioned results as concerns plastics and their revitalization and coloring is as follows: The formulation given above, when applied by a wiping agent, for example, but not limited to, cloth, paper, roller, spray, or other means, or applied by, for example, but not limited to, dipping, full immersion, etc will impart a revitalization, which is defined as a chemically-bound coating which returns plastics to original or better than original condition. By revitalization to a potentially better-than-original condition, the inventor claims that the sheen produced is better than the original sheen in many cases, minor abrasions are removed, weathering effects are reversed, and an extra protective layer is provided as well. Plastics, over time, lose sheen, suffer UV degradation, are worn by weathering, are affected by plasticizer degradation, experience abrasion and other detrimental effects of aging. No pre-treatment of the surfaces, aside from the removal of obvious surface dirt is required in the great majority of cases, but there may be cases where pre-treatment for purposes of mechanical adhesion may be helpful for optimal results. The process for coloring plastics is the same as the revitalization process, except that the formulations include dyes or pigments and these processes may be used prior to (i.e., in pellet form) or after product formation.

Because of the vast number of plastics available, it is not possible for the inventor to claim this process works on all plastics, but the following example should assure the user that the process works on a very wide range of plastics: On the average passenger automobile, there are at least twelve (12) different types of plastics and at least six (6) different types of rubber. The base formulation described herein has been used on (exterior) molding, roof racks, bumpers, cowling, mirror housings, mud flaps, wheelwell guards, door handles, step treads, headlight lenses, tires, windshield wipers, etc; (interior) dashboards, consoles, door panels, window seals, seats, steering wheel column, weatherstripping, wire insulation, etc; (under the hood) air intake, battery compartment, fan cowling, rubber hosing, hose sleeves, brake fluid reservoir, etc. All items treated were wiped (cloth) once by hand with the same base formulation without a prep stage, as the formulation has an inherent cleaning aspect due to the Aliphatic hydrocarbon content. The applications were air-dried. Current retail products which claim some similar results are basically waxes, polishes, and cleaners. None are used as universally as this invention (never under the hood, for example) and are effective, as a general rule, for a week or two. The treatments applied as described above are nearing two (2) years with, in most cases, less than 10% degradation.

The above example is given as a specific set of applications for purposes of illustration, but these formulations will also apply to the broad range of plastics including, but not limited to, construction materials, outdoor furniture, appliances, wire, etc, etc. This invention may also be used to treat sheet plastic, for example, but not limited to, polyvinyl acetate (PVA), polyvinyl chloride (PVC), Polypropylene, etc when the user intends to color the sheeting or to provide a surface which will accept water-based inks and be printable with the same presses used to print paper. Because the process uses no heat, the potential for sheeting application should have no thickness restrictions. End uses may include, but not be limited to, product packaging, signage, advertisement materials, road signs, etc.

Second Embodiment

The process which accomplishes the results described concerning natural and synthetic rubber are the same as described for textiles in the Third Embodiment; as in that application, no pre-treatment should be used. Simple contact at room temperature or in a wide range of outdoor temperatures (for example, 32 degrees to 110 degrees F.) is enough to ensure the chemical bond which allows the results described in an earlier section. According to major suppliers of rubber, this is the first time rubber has been able to be dyed after it has been made into a product without changing the general performance characteristics of those rubbers. For example, hevea rubber made for use as a textile elastomer (as used in bungee cords, waistbands, suspenders, and hundreds of other products), in this case 34 gauge rubber thread (which has a useful life expectancy of approximately 2 years, according to the manufacturer), was treated with this invention with dye included. The result was a dyed rubber which retained its original performance characteristics (stretch, recovery, modulus, etc), and would be as useful today in standard applications as during its intended lifespan. This sample was treated fifteen (15) years ago; this indicates that a certain aspect of longevity of usefulness has been introduced by this invention (what the inventor calls "fortification," which is distinct from other processes such as vulcanization).

Coloration and fortification of rubber may also be achieved prior to product forming if the user includes this invention with colorants (dyes and pigments) in the solid or liquid states of rubber prior to product formation. This invention may also be used to color carbon black before it is included in the compound mix, ensuring a better "jetness" to the black through the entire body of the finished product. Other methods are used to color carbon black, but they are, by their own description, "paints"; this invention introduces a penetration dye or pigment coloring. The alternative methods are recommended for use on rubber products where there is no need for retention of performance characteristics, such as in tires recycled for use as playground and road surfaces. In some cases, for example, but not limited to, when the flash point of the formulation is of concern to the end user, this invention may be applied to carbon black when used in rubber and plastics compounding, prior to inclusion in the product compound.

Third Embodiment

This invention, when used in textile processing applications, represents a complete departure from the conceptual approaches and practices used today and through most of the history of textiles. Throughout the history of textiles, several basic steps were required to continuously dye fabrics: (A) a preparation in solution of colorants, distinct for different fibres; (B) a basin or tank, preferably heated, for goods to pass through and absorb colorant chemicals; © Squeeze rollers to eliminate excess colorant liquid; (D) a finishing range consisting of a series of large cylinders injected with steam which cures the dyestuffs, regularizes their dispersement, and dries the fabric. Other equipment may be present as well, for example, pre-dye treatment baths, heat ovens for drying, etc, but the basic principle remains the same, and is, more or less, universally used today. Package yarn dyeing and finished goods dyeing are done using the same basic steps, but using equipment more appropriate to the product being processed, such as pressurized heated kettles, skein dyeing apparati, etc. Improvements on this system have been on the order of (1) chemically improved dyestuffs, (2) improved equipment for processing, such as the introduction of electricity and more sophisticated machinery, (3) more efficient means for delivering goods through processing, (4) computer-assisted dye formulation and testing, and others, but the necessary basic procedures remained unchanged.

This invention streamlines those procedures radically while producing a product result equal to or better in terms of quality of dyeing. The equipment needed for the invention is (A) a dye bath exactly as used previously, but without heat, and, (B) a connected "wicking cabinet," which is described as a simple stainless steel box of appropriate size (somewhat similar to what is known to the trade as a steam box, but without the steam), which has been fitted with horizontal stainless rods, as many as are appropriate for a given type of production.

The goods to be processed, for example, but not limited to, 72" broad fabrics or multiple ends of 2" narrow fabrics, are run through the dye bath as has been done for centuries, but in this case without heat. It is preferred, indeed recommended, by the inventor that no pre-dye treatment be applied to textile goods, with the single exception of monofilament amides, polyesters, etc because of the content of plasticizers and their tendency to migrate to the surface; multi-filament yarns of these same materials need no pre-treatment as the plasticizer migration is spread over a much larger surface area and has no practical effect on the application of this invention. As only simple contact with the formulations described herein is necessary to ensure dye penetration, the goods may be run a fast as the feeding machinery (for example, but not limited to, creels, beams, fabric rolls, etc) will allow. In trials we have not found a fabric (see list of potentially dyeable fabrics elsewhere in this description) which required more than a one (1) second immersion time, including US Military Spec Mil-W-4088 Type XXVI, which is one of the heaviest and densest nylon webbing commonly used by the US government. All fabrics dyed were dyed fully through, and because this system is based on molecular correspondence, the dyeing has very even dispersion. The goods being processed, once through the dye bath and without being subjected to squeeze rollers (used traditionally to squeeze out unattached dyestuff liquid), enter the wicking cabinet and travel over and around the stainless rods (as many as are deemed necessary for a particular product) for the purposes of "drying" the goods, which is really a process to promote evaporation of the parts of the formulation which conveyed the dyestuffs to the fabrics, but are no longer part of the dyed material. In some cases, the wicking cabinet may be enhanced by a dry-air heat application, similar to a common clothes dryer (for example, but not limited to, 130-140 degrees F. or 55-60 degrees C.); this possible heat addition is not for curing or "seating" dyes, as that has been done earlier in the process, but only to encourage faster evaporation of elements no longer necessary in the finished product. Products dyed with this invention may be air-"dried" at room temperature if preferred.

Some advantages of this invention to the user are:

The base formulation given, with solvent-based dyes or pigments added, will dye any of the common fibre types, for example, but not limited to: cellulose-based (cottons, rayons, jutes, hemps, etc); polyesters; polyamides (nylon 6, nylon 6.6, Conex, etc); polypropylenes; polyaramides (Kevlar, Nomex, etc); PTFE fluoropolymers (Teflon, etc); Endumax and others. The same formulation will dye all of these fibres, including blends and combinations of these fibres, but the user is encouraged to adjust the formula to optimize specific desired outcomes if necessary.

This is the first process which (1) dyes all these above fibres with one formulation; (2) dyes materials previously considered to be undyeable in the fibre or fabric state, such as Kevlar, Conex, Teflon, Nomex, Polypropylene, and others, and because of the type of chemical bonding, fibres yet to be developed may enjoy the benefits of this invention; (3) dyes without using heat, which means there is no shrinkage, no fibre destruction (as with, for example, polypropylene, which melts at 340 degrees F./171 degrees C.); (4) allows the manufacturer the freedom to not have to distinguish woven, knitted, braided, purchased, and/or non-woven goods which were intended as finished goods in white or natural and those intended for dyeing (greige goods) because greige goods are prepared to account for shrinkage in the dye process due to the heat used (between 3 and 10% in many cases). There is no shrinkage in the present process because there is no heat.

Products which are difficult to dye by traditional means because of heat alteration in the dyeing and curing processes, such as, but not limited to, lightweight fabrics, sheer fabrics, non-wovens, embossed fabrics, delicate embroideries, tufted articles, etc can be processed easily using this invention. Products which are not flat or nearly flat, such as, but not limited to, ropes, cords, cord-edged fabrics, braids, tassel fringes, ball fringes, laces, trimming treatments for home furnishing and apparel products, etc can be processed easily using this invention because there are no squeeze rollers and no finishing (curing and drying) range.

As the immersion time is less than one (1) second, and because there are no after-curing processes, materials may be run as fast as one's loading and take-up machinery will allow. Traditionally, there are speed-of-run limits imposed by the (1) weight and density of the material (limiting dye infusion), and (2) the physical limitations of the large steam cylinders (called "cans") to rotate any faster than a few yards per minute in the curing part of the process. Traditionally, the compensation to achieve volume production is (in the case of narrow goods) to run multiple ends of a product at the same time. This invention also allows multiple ends in the same circumstances, but with one (1) second immersion time and no finishing range, the user can expect to increase his processing time by a factor of four (4) to ten (10) times, possibly more, producing a commensurate amount of finished goods.

The color preparation (dyes or pigments) is as follows: Into a beaker of measured formulation add a measured percentage of dyestuff and mix the solution at room temperature. Dip a small sample of the material to be dyed into the solution and that is the exact color which will emerge as a result of processing. Traditional dyeing methods require much more expertise because (1) different fibres require different dyebath configurations before the colorant is added; (2) the changes imparted by multiple heat applications change the effects of color depth, dispersion, etc, which require a fair amount of expertise which is usually provided by a dyemaster who employs a combination of science, art, and experience to produce a desired color. This invention requires only the ability to understand how primary and secondary colors combine to make the full spectrum.

The introduction of this invention will allow a manufacturer, processor, distributor, importer, etc of any size to be his own dyer; a circumstance, because of the cost and operation of necessary machinery, the necessity of scientific knowledge, and other factors, which was not previously considered practical. The essential equipment necessary to perform the processes of this invention already exist in a manufacturing facility using traditional processing machinery (specifically, the dyebath tank), or can be adapted from existing equipment used for other purposes (specifically, the wicking chamber, which is just a stainless steel box of suitable size with stainless steel bars inside). The material loading apparatus (creels, beams, greige goods containers) and the collection apparatus (winders, blockers, beams, collection containers) are all standard items in a textile mill. If a user had never done dye processing previously, a serviceable version of equipment to do this process could probably be installed for approximately $10,000 US as compared with the cost of a finishing range alone, which can cost anywhere from $10,000 US (for a 1-can set-up) to several million dollars (for ranges fully two stories high and several hundred feet in length).

The formulations are solvent-based, and, although aqueous-based dye solutions are preferred currently, chiefly due to health and environmental concerns, it can be argued that the formulations and processes associated with this invention are actually preferable to aqueous methods in that they are more friendly to the environments affected. The primary environment is inside the processing plant; traditionally, workers have been exposed to the evaporating elements released into the air as the dyeing, curing, and drying are taking place, which is why dyehouses are densely humid atmospheres. That humidity includes not only the aqueous base of the colorant material, but also the dyestuff chemicals, fixatives, and any number of other additives which may have been added. This invention is solvent-based, and is applied by, as described in a prior section, a quick immersion into a dyebath which is closed to the air, then through closed passages through to the wicking chamber, which is also a closed unit and has a hose vent, similar to a clothes dryer, except that it has "scrubber" filters, which remove anything undesirable from being released into the air (the secondary environment) outside the facility. There are types of catalytic convertors which may be adapted for similar purposes. This would greatly improve the in-plant conditions of the workers without releasing anything dangerous to the environment. At the end of a processing run using traditional technology, the excess dyebath liquid (now waste) is dumped into drains which carry this waste to the sewer system and on to the treatment facilities. While this is an improvement on the time-honored dump-it-in-the-river or pour-it-in-the-holding tank or open-air cistern, the accepted modern solution is not ideal either. By contrast, this invention is 99+% usable, as all colors will eventually go to black or can be made black by adding black colorants; no dye "liquor" is thrown out. The inventor says 99+% usable because there is inevitably some lint or detritus from the processed material which ends up in the dye liquor. This is removed by filtering through mesh, cheesecloth, or similar means and the dye liquor is "as good as new." This detritus is well under 1% of the total volume and can be disposed of as solid waste. The fact that this invention can dye cottons, delicate fabrics, and be strained through cheesecloth speaks to the relatively benign nature of this invention. Suggested personal safety protection include eye protection, rubber (nitrile) gloves, and otherwise standard work clothes. An ancillary environmental benefit to this invention is the savings involved in not having to power (which is provided, often, by fossil fuels) the traditional equipment which provide the heat treatments necessary to process goods currently.

Savings involved in energy costs, labor and overhead costs (because of the significantly increased yields), the inventory reduction costs (as this system is simpler to load, use, and change), and the reduced amount of manufacturing space necessary to use this invention are not insignificant.

The processes described herein have had to do with products in solid colors; striped patterns and other color designs can be achieved by running yarn through this same process, formulations, and equipment for dyeing (known as "slash dyeing" when applied to yarn) before those yarns are sent through looms, knitters, braiders, rope-making equipment, etc and made into finished fabrics. As for products intended for printing, a pass through the process of this invention, in base (clear) form or with dyes or pigments will leave a surface which may be printed using water-based inks on standard paper presses, which is much more economical than using, for example, but not limited to, sublistatic (paper transfer) printing.

In a more general sense, this invention may be useful to an importer of, as an example, men's polo shirts, which must be ordered at least 90 days before they are to be offered on retail shelves. This means the colors, the distribution of colors over sizes (small through 5XL, commonly) and the quantities of units of each must be pre-determined a season ahead of the retail sale date. If these shirts were all brought in as whites (or "blanks," as they may be called), and dyed to color as needed, the turnaround time would be greatly reduced and it would give the supplier more freedom to supply preferred colors (as opposed to slower-selling colors) along with other advantages of what might be called "flexible" (as opposed to "fixed") inventory. This principle would be applicable to thousands of other products as well.

This invention may also be useful in areas with limited water resources, such as the northern coast of Africa, large parts of the Mideast, parts of Asia, etc and geographic locations with less sophisticated water treatment systems.

CONCLUSIONS, RAMIFICATIONS, AND SCOPE

The inventor has reason to believe this invention represents an approach to textile processing which, in conception and execution, has not been seen before in that industry. This conclusion is derived from his own 30 years of experience in the field, and the valued opinions of many other persons, company owners and executives, processing engineers, research and development personnel, material suppliers, etc who are significant in the textile industry and who are associated with the leading companies in these fields. It is not enough that this invention be simply different from established approaches; to be useful, it must present, ideally, a more simplified approach, a more universally applicable approach, a more cost-effective approach, additional options for production methods, improved products, and it must produce results equal to or better than those produced before this invention. The inventor believes this has been accomplished with additional benefits, such as the ability to dye fibres and fabrics which had heretofore been considered undyeable and, arguably, some better options as concerns the environment relative to manufacturing practices. The advantages it presents for other industries, among them the rubber and plastics industries mentioned herein, are more in the nature of providing options which were not formerly available.

I claim:

1. A process for dyeing textiles, rubber or carbon black materials, the process comprising applying a liquid formulation comprising 40-85% by weight solvent aliphatic hydrocarbons, 7-35% by weight alkyd resin compounds, 5-15% by weight light aromatic solvent naptha compounds, 1-5% by weight N-Methyl-2-Pyrrolidone, 0.5-1.5% by weight 2-butanone oxime, 0.01-1% by weight cobalt octoate, 0.05-0.3% by weight calcium napthenate, 0.2-0.8% by weight zirconium octoate and solvent compatible dyes or pigments to the material, wherein the dye penetrates fully through the entire body of the material and has even dispersion.

2. The process of claim 1, wherein the rubbers are selected from the group consisting of synthetic rubbers or natural rubbers or combinations thereof.

3. The process of claim 1, wherein the textiles are selected from the group consisting of cellulosics, silk, polyesters, polypropylenes, amides, aramides, fluoropolymers or acrylics.

4. The process of claim 1, wherein the materials are carbon black.

5. The process of claim 1, wherein the liquid formulation further comprises UV protectants, free radical inhibitors, sizing agents, stiffeners, hardeners, mercerizing agents, stain protectants, mildew resistants, softeners, glazes, color enhancers, sheen providers and corrosion protectants.

* * * * *